US008613307B2

(12) United States Patent
Kim et al.

(10) Patent No.: US 8,613,307 B2
(45) Date of Patent: Dec. 24, 2013

(54) FINNED TUBE HEAT EXCHANGER

(75) Inventors: Hyunyoung Kim, Sakai (JP); Hirokazu Fujino, Sakai (JP); Toshimitsu Kamada, Sakai (JP); Kazushige Kasai, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 1075 days.

(21) Appl. No.: 12/442,977

(22) PCT Filed: Sep. 28, 2007

(86) PCT No.: PCT/JP2007/068993

§ 371 (c)(1),
(2), (4) Date: Mar. 26, 2009

(87) PCT Pub. No.: WO2008/041635

PCT Pub. Date: Apr. 10, 2008

(65) Prior Publication Data

US 2010/0089557 A1 Apr. 15, 2010

(30) Foreign Application Priority Data

Oct. 2, 2006 (JP) ..... 2006-270713
Mar. 23, 2007 (JP) ..... 2007-076711

(51) Int. Cl.
*F28D 1/04* (2006.01)
*F28F 1/20* (2006.01)
*F28F 1/30* (2006.01)

(52) U.S. Cl.
USPC ..... 165/151; 165/181; 165/182

(58) Field of Classification Search
USPC ..... 165/151, 181–182
See application file for complete search history.

(56) References Cited

U.S. PATENT DOCUMENTS 4,434,844 A * 3/1984 Sakitani et al. ..... 165/151
4,709,753 A * 12/1987 Reifel ..... 165/125

(Continued)

FOREIGN PATENT DOCUMENTS

JP 61-110889 A 5/1986
JP 62-206384 A 9/1987

(Continued)

OTHER PUBLICATIONS

Korean Office Action of corresponding Korean Patent Application No. 10-2009-7008507 dated Oct. 5 2011.
Korean Office Action of corresponding Korean Patent Application No. 10-2009-7008507 dated Mar. 9, 2011.

*Primary Examiner* — Mohammad M Ali
*Assistant Examiner* — Ian Soule
(74) *Attorney, Agent, or Firm* — Global IP Counselors

(57) ABSTRACT

A finned tube heat exchanger includes a plurality heat-transfer fins and a plurality of heat-transfer tubes. The heat-transfer fins are disposed along an airflow direction. The plurality of heat-transfer tubes are inserted into the heat-transfer fins and arranged in a direction substantially orthogonal to the airflow direction. Each of the heat transfer fins includes a plurality of sets of cut-and-raised parts with each set being straightly aligned from the upstream side toward the downstream side. At least one set of cut-and-raised parts is connected by a straight line sloped relative to the airflow direction. Each of the heat transfer fins includes a plurality of concavities with each concavity formed on a periphery of one of the heat-transfer tubes at least partially below a horizontal plane that passes through a center axis of the heat-transfer tubes and lies on an upper surface of the heat transfer fin having the concavity formed therein.

17 Claims, 12 Drawing Sheets

(56) References Cited

U.S. PATENT DOCUMENTS

| | | | | | |
|---|---|---|---|---|---|
| 4,984,626 | A | * | 1/1991 | Esformes et al. | 165/151 |
| 4,997,036 | A | * | 3/1991 | Schulze et al. | 165/182 |
| 5,203,403 | A | * | 4/1993 | Yokoyama et al. | 165/151 |
| 5,207,270 | A | * | 5/1993 | Yokoyama et al. | 165/151 |
| 5,730,214 | A | * | 3/1998 | Beamer et al. | 165/152 |
| 6,578,627 | B1 | * | 6/2003 | Liu et al. | 165/109.1 |
| 2004/0194936 | A1 | | 10/2004 | Torii | |
| 2005/0077036 | A1 | * | 4/2005 | Antonijevic | 165/182 |

FOREIGN PATENT DOCUMENTS

| | | | |
|---|---|---|---|
| JP | 08-86584 | A | 4/1996 |
| JP | 09-79777 | A | 3/1997 |
| JP | 9-203593 | A | 8/1997 |
| JP | 10-89876 | A | 4/1998 |
| JP | 10-332291 | A | 12/1998 |
| JP | 11-166796 | A | 6/1999 |
| JP | 2000-171187 | A | 6/2000 |
| WO | WO-03/014649 | A1 | 2/2003 |

* cited by examiner

FINNED TUBE HEAT EXCHANGER

CROSS-REFERENCE TO RELATED APPLICATIONS

This U.S. National stage application claims priority under 35 U.S.C. §119(a) to Japanese Patent Application Nos. 2006-270713, filed in Japan on Oct. 2, 2006, and 2007-076711, filed in Japan on Mar. 23, 2007, the entire contents of which are hereby incorporated herein by reference.

TECHNICAL FIELD

The present invention relates to a finned tube heat exchanger, and particularly to a finned tube heat exchanger provided with heat-transfer fins disposed along an airflow, and a plurality of heat-transfer tubes inserted into the heat-transfer fins and arranged in a direction substantially orthogonal to the direction of airflow.

BACKGROUND ART

Often used in a conventional air conditioning apparatus or the like is a finned tube heat exchanger (i.e., cross fin-and-tube heat exchanger) provided with heat-transfer fins disposed along an airflow, and a plurality of heat-transfer tubes inserted into the heat-transfer fins and arranged in a direction substantially orthogonal to the direction of airflow. Therefore, a method using cut-and-raised machining is sometimes adopted in a finned tube heat exchanger for enhancing heat transfer by forming parts that are cut, raised up, and opened toward the upstream side of the airflow direction in positions of the heat-transfer fin surfaces on the two sides of the heat-transfer tubes, for the purpose of renewing the boundary layers on the heat-transfer fins and reducing the dead water regions formed in parts of the heat-transfer fins downstream of the heat-transfer tubes in the airflow direction (see Japanese Laid-open Patent Application No. 61-110889).

SUMMARY OF THE INVENTION

<Technical Problem >

When a finned tube heat exchanger that employs cut-and-raised parts as described above is used as an evaporator having refrigerant or another heating medium in which air is used as a heat source typified by an air conditioning apparatus or the like, there is a problem in that condensed water and other water droplets (hereinafter referred to as "drain water") generated by heat exchange between air and the heating medium are trapped in the cut-and-raised parts and cause ventilation resistance to increase.

An object of the present invention is to provide a finned tube heat exchanger having both a heat transfer enhancing effect produced by the cut-and-raised parts and drainage efficiency.

<Solution to Problem>

The finned tube heat exchanger according to a first aspect is provided with heat-transfer fins and a plurality of heat-transfer tubes. The heat-transfer fins are disposed along an airflow. The plurality of heat-transfer tubes is inserted into the heat-transfer fins and arranged in a direction substantially orthogonal to the airflow direction. A plurality of cut-and-raised parts is formed in the heat-transfer fins by cut-and-raise machining, the parts being straightly aligned from the upstream side toward the downstream side in the airflow direction on two sides, as viewed in a perpendicular direction, of the heat-transfer tubes. Imaginary straight lines that connect the plurality of cut-and-raised parts are sloped relative to the airflow direction so that the airflow in the vicinity of the heat-transfer tubes is guided to the rearward side of the heat-transfer tubes in the airflow direction. Concavities are formed in the heat-transfer fins about the periphery of the heat-transfer tubes at least in a part below a horizontal plane that passes through a center axis of the heat-transfer tubes.

In the finned tube heat exchanger, a plurality of cut-and-raised parts is divided from the upstream side toward the downstream side in the airflow direction. The plurality of cut-and-raised parts is disposed in the forward area in the airflow direction so that air in the vicinity of the heat-transfer tubes is guided to the rearward side of the heat-transfer tubes in the airflow direction. The cut-and-raised parts are not provided in a portion of the heat-transfer fins toward the lower part of the heat-transfer tubes. Concavities are formed at least in the lower part of the periphery of the heat-transfer tubes in the heat-transfer fins.

Therefore, an effect can be obtained in which the boundary layers are renewed by the cut-and-raised parts. An effect can also be obtained in which the dead water regions formed in the portions of the heat-transfer fins disposed rearward in the airflow direction are reduced. Drain water can be made less liable to be trapped between the heat-transfer tubes and the cut-and-raised parts. Drain water generated on the surface of the heat-transfer fins can furthermore be made to be more readily removed from the gaps between the cut-and-raised parts. Drain water is temporarily trapped in the concavities, and is then made to flow downward and be removed after a predetermined amount or more of the drain water has accumulated. Consequently, a heat transfer enhancing effect produced by the cut-and-raised parts can be obtained without being affected by drain water generated on the surface of the heat-transfer fins.

The finned tube heat exchanger according to a second aspect is the finned tube heat exchanger according to the first aspect, wherein concavities are formed in the heat-transfer fins about the entire periphery of the heat-transfer tubes.

In the present invention, concavities are formed in the heat-transfer fins about the entire periphery of the heat-transfer tubes. Therefore, drain water is temporarily trapped in the concavities, and is then made to flow downward and be removed after a predetermined amount or more of the drain water has accumulated. Accordingly, the drain water can be removed without being trapped between the heat-transfer tubes and the cut-and-raised parts. A heat transfer enhancing effect can be obtained thereby.

The finned tube heat exchanger according to a third aspect is the finned tube heat exchanger according to the first or second aspect, wherein the heat-transfer fins are shaped as waffles having folds formed in a direction substantially orthogonal to the airflow direction.

In the present invention, the heat-transfer fins are shaped as waffles having folds formed in a direction substantially orthogonal to the airflow direction.

Therefore, heat exchange between the heat-transfer fins and air can be enhanced. Drain water can be more readily brought to the folds and made to flow downward. Accordingly, a heat transfer enhancing effect produced by the cut-and-raised parts can be obtained without being affected by drain water generated on the surface of the heat-transfer fins.

The finned tube heat exchanger according to a fourth aspect is the finned tube heat exchanger according to the first or second aspect, wherein the concavities have lower end parts and upper end parts. The lower end parts and the upper end parts have a protruding shape. In this case, a first point on the lower parts of the concavities is set to be a vertex of the lower end parts. A second point at the upper parts of the concavities is set to be a vertex of the upper end parts.

In the present invention, the concavities are shaped so that a protruding shape is given to the lower end parts whose vertices are set to be the first points in the lower parts of the concavities, and to the upper end parts whose vertices are set to be the second points in the upper parts of the concavities. Therefore, generated drain water can be more readily removed from the concavities. Accordingly, drain water generated in the heat exchanger can be made to flow smoothly downward.

The finned tube heat exchanger according to a fifth aspect is the finned tube heat exchanger according to the first or second aspect, wherein the concavities have lower end parts whose vertices are set to be first points on the lower parts thereof. The concavities are also shaped so that a protruding shape is given to the lower end parts.

In the present invention, the concavities are shaped so that a protruding shape is given to the lower end parts whose vertices are set to be the first points in the lower parts of the concavities. Therefore, generated drain water can be more readily removed from the concavities. Accordingly, the drain water generated in the heat exchanger can be made to flow smoothly downward.

The finned tube heat exchanger according to a sixth aspect is the finned tube heat exchanger according to the third aspect, wherein the folds are shaped at least as concave folds. The concavities have lower end parts whose vertices are set to be first points on the lower parts thereof. The concavities are shaped so that a protruding shape is given to the lower end parts, and are formed so that there is a match between the lower end parts and the concave folds.

In the present invention, the concavities are formed so that the downward protruding lower end parts are superimposed on the concave folds. Therefore, the generated drain water can be more readily removed from the concavities. Accordingly, drain water generated in the heat exchanger can be made to flow smoothly downward.

The finned tube heat exchanger according to a seventh aspect is the finned tube heat exchanger according to the sixth aspect, wherein the cut-and-raised parts are formed in a region that excludes the region directly below the heat-transfer tubes. Therefore, the generated drain water can be more readily removed from the concavities. Accordingly, drain water generated in the heat exchanger can be made to flow smoothly downward.

The finned tube heat exchanger according to an eighth aspect is the finned tube heat exchanger according to the sixth or seventh aspect, wherein the plurality of cut-and-raised parts includes a plurality of first cut-and-raised parts and a plurality of second cut-and-raised parts. The plurality of first cut-and-raised parts is formed below the heat-transfer tubes. The plurality of second cut-and-raised parts is formed above the heat-transfer tubes. A first imaginary straight line that connects the plurality of first cut-and-raised parts is sloped in relation to the third straight line that passes through the center axis of the heat-transfer tubes and is parallel to the airflow direction, so that the downstream side in the airflow direction is farther away than the upstream side from the third straight line. A second imaginary straight line that connects the plurality of second cut-and-raised parts is sloped in relation to the third straight line so that the downstream side in the airflow direction is closer than the upstream side to the third straight line.

In the present invention, the first cut-and-raised parts formed below the heat-transfer tubes are sloped in relation to the third straight line that passes through the center axis of the heat-transfer tubes and is parallel to the airflow direction, so that the downstream side in the airflow direction is farther away than the upstream side from the third straight line. In other words, the first cut-and-raised parts formed below the heat-transfer tubes where drain water is readily trapped are arranged in a sloped manner so that there is a match between the airflow direction and the direction in which drain water flows and falls downward.

Therefore, when drain water has been generated, the drain water can be readily removed without being trapped between the heat-transfer tubes and the cut-and-raised parts. Accordingly, the water drainage performance of the heat-transfer fins can be improved and the heat transfer effect can be enhanced.

<Advantageous Effects of Invention>

In the finned tube heat exchanger according to the first aspect, an effect can be obtained in which the boundary layers are renewed by the cut-and-raised parts. An effect can also be obtained in which the dead water regions formed in the portions of the area rearward of the heat-transfer fins in the airflow direction are reduced. Drain water can be made less liable to be trapped between the heat-transfer tubes and the cut-and-raised parts. Drain water generated on the surface of the heat-transfer fins can furthermore be more readily removed from the gaps between the cut-and-raised parts. Drain water is temporarily trapped in the concavities, and is then made to flow downward and be removed after a predetermined amount or more of the drain water has accumulated. Consequently, a heat transfer enhancing effect produced by the cut-and-raised parts can be obtained without being affected by drain water generated on the surface of heat-transfer fins.

In the finned tube heat exchanger according to the second aspect, drain water is temporarily trapped in the concavities, and is then made to flow downward and be removed after a predetermined amount or more of the drain water has accumulated. Accordingly, the drain water can be removed without being trapped between the heat-transfer tubes and the cut-and-raised parts. A heat transfer enhancing effect can be obtained thereby.

In the finned tube heat exchanger according to the third aspect, heat exchange between the heat-transfer fins and air can be enhanced. Drain water can be more readily brought to the folds and made to flow downward. Accordingly, a heat transfer enhancing effect produced by the cut-and-raised parts can be obtained without being affected by drain water generated on the surface of the heat-transfer fins.

In the finned tube heat exchanger according to the fourth aspect, the generated drain water can be more readily removed from the concavities. Accordingly, drain water generated in the heat exchanger can be made to flow smoothly downward.

In the finned tube heat exchanger according to the fifth aspect, the generated drain water can be more readily removed from the concavities. Accordingly, drain water generated in the heat exchanger can be made to flow smoothly downward.

In the finned tube heat exchanger according to the sixth aspect, the generated drain water can be more readily removed from the concavities. Accordingly, drain water generated in the heat exchanger can be made to flow smoothly downward.

In the finned tube heat exchanger according to the seventh aspect, the generated drain water can be more readily removed from the concavities. Accordingly, drain water generated in the heat exchanger can be made to flow smoothly downward.

In the finned tube heat exchanger according to the eighth aspect, when drain water has been generated, the drain water can be readily removed without being trapped between the heat-transfer tubes and the cut-and-raised parts. Accordingly, the water drainage performance of the heat-transfer fins can be improved and the heat transfer effect can be enhanced.

DETAILED DESCRIPTION OF THE INVENTION

Embodiments of the finned tube heat exchanger according to the present invention will be described below with reference to the drawings.

Figure 1:
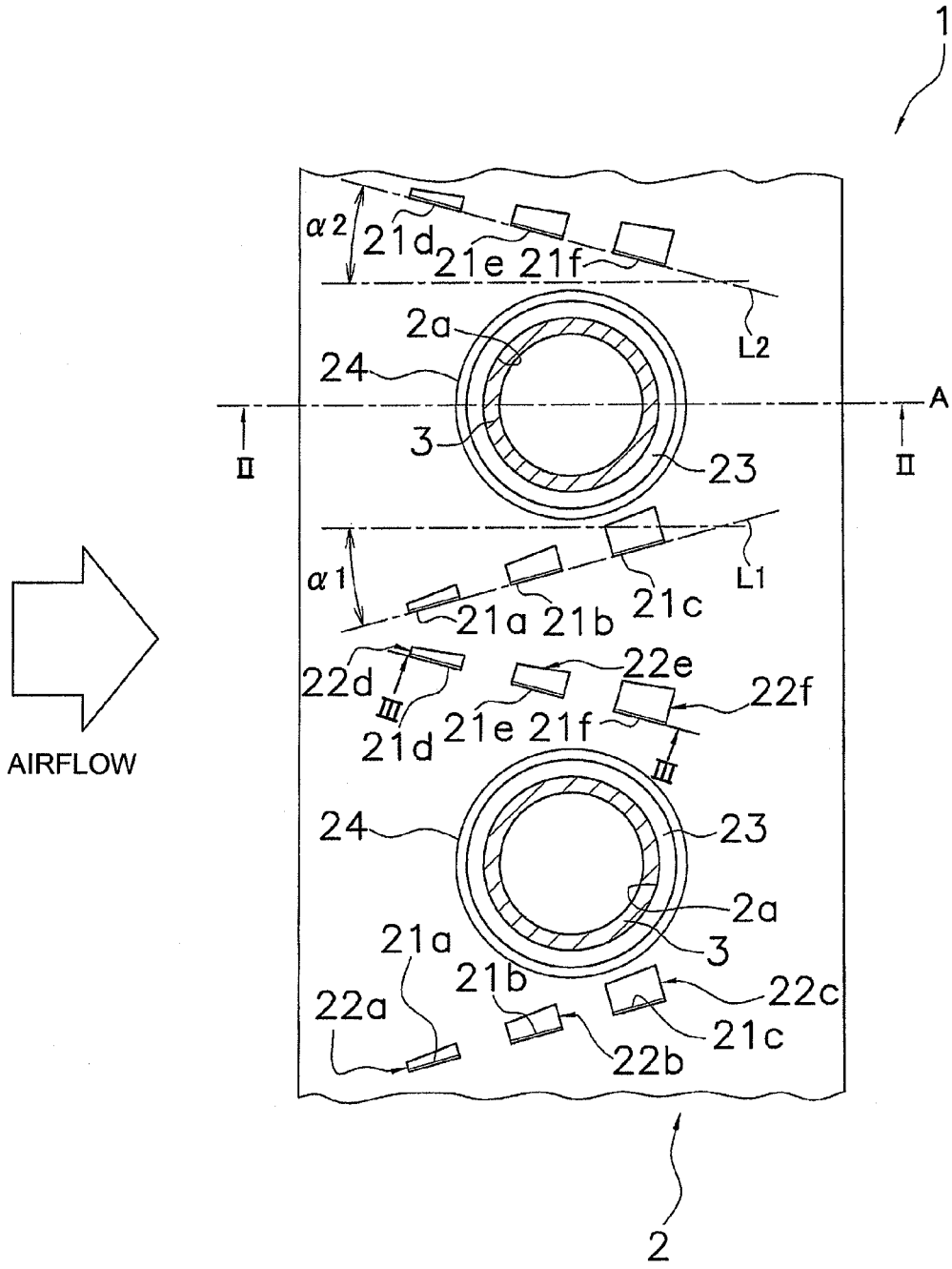
FIG. 1 is a cross-sectional view of a finned tube heat exchanger according to an embodiment of the present invention.
Figure 2:
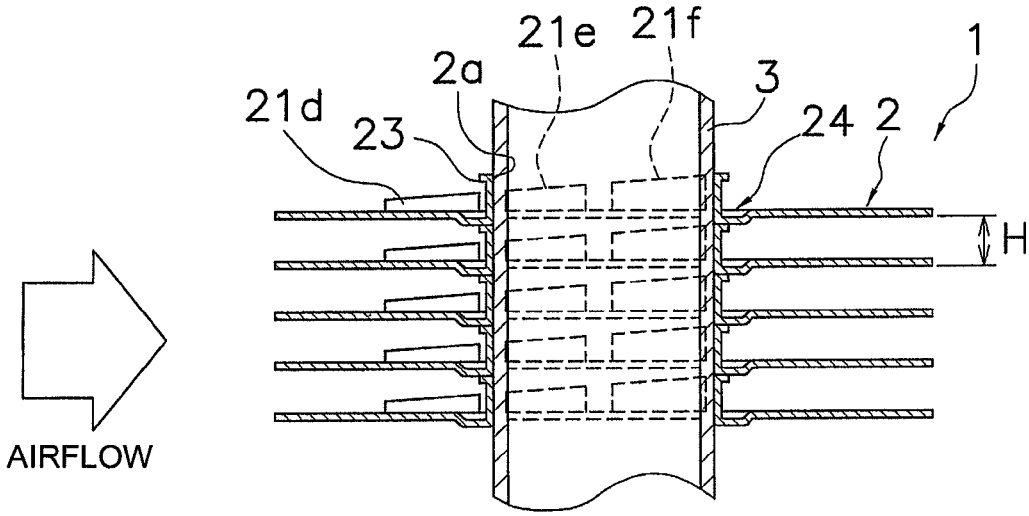
FIG. 2 is a cross-sectional view along the line II-II of FIG. 1.
Figure 3:
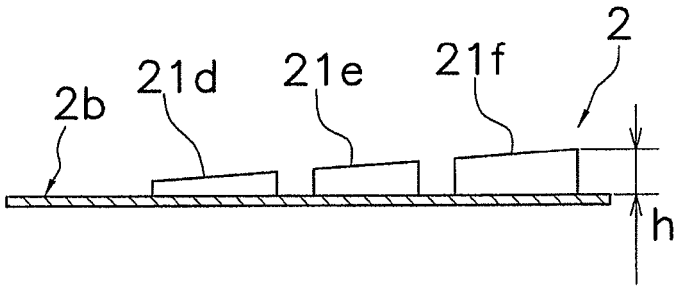
FIG. 3 is a cross-sectional view along the line of FIG. 1.

FIGS. 1 to 3 show the main part of the finned tube heat exchanger 1 according to an embodiment of the present invention. Here, FIG. 1 is a cross-sectional view of the finned tube heat exchanger 1. FIG. 2 is a cross-sectional view along the line II-II of FIG. 1. FIG. 3 is a cross-sectional view along the line of FIG. 1.

(1) Basic Configuration of the Finned Tube Heat Exchanger

The finned tube heat exchanger 1 is a cross fin-and-tube heat exchanger, and is mainly composed of a plurality of plate-shaped heat-transfer fins 2 and a plurality of heat-transfer tubes 3. The heat-transfer fins 2 are aligned and disposed in the plate thickness direction in a state in which the plane direction of the fins is made to substantially match the airflow direction of air or the like. A plurality of through-holes 2*a* is formed in the heat-transfer fins 2 at intervals in the direction substantially orthogonal to the airflow direction. The peripheral portion of the through-holes 2*a* is an annular collar part 23 that protrudes to one side in the plate thickness direction of the heat-transfer fins 2. The collar part 23 makes contact with the surface opposite from the surface on which the collar part 23 of the heat-transfer fins 2 adjacent in the plate thickness direction is formed, and a predetermined interval H is maintained between each heat-transfer fin 2 in the plate thickness direction. The heat-transfer tubes 3 are tube members through which a refrigerant or another heating medium flows inside, are inserted into the plurality of heat-transfer fins 2 aligned and disposed in the plate thickness direction, and are arranged in a direction substantially orthogonal to the airflow direction. Specifically, the heat-transfer tubes 3 are passed via the through-holes 2*a* formed in the heat-transfer fins 2 and are brought into close contact with the inside surface of the collar part 23 by expanding the tube during assembly of the finned tube heat exchanger 1.

The finned tube heat exchanger 1 of the present embodiment is used in a state in which the plurality of heat-transfer tubes 3 is arranged so as to be aligned substantially in the vertical direction. Accordingly, the airflow moves crosswise to the finned tube heat exchanger 1, substantially toward the horizontal direction. In the following description, the terms "upper side," "upper," "lower side," and "lower" refer to the arrangement direction of the heat-transfer tubes 3.

(2) Specific Shape of the Heat-Transfer Fins

Next, the specific shape of the heat-transfer fins 2 used in the finned tube heat exchanger 1 of the finned tube heat exchanger according to the present embodiment will be described.

A plurality (three on each lower and upper side in the present embodiment) of cut-and-raised parts 21*a* to 21*f* formed in the surfaces of the heat-transfer fins 2*b* by the cut-and-raise machining is disposed on the heat-transfer fins 2, the cut-and-raised parts being straightly aligned from the upstream side toward the downstream side in the airflow direction on two sides of the heat-transfer tubes 3 in a perpendicular direction (i.e., lower and upper side of each heat-transfer tube 3). Here, the lower cut-and-raised parts are first cut-and-raised parts 21*a* to 21*c*, and the upper cut-and-raised parts are second cut-and-raised parts 21*d* to 21*f*. A first imaginary straight line L1 that connects the first cut-and-raised parts 21*a* to 21*c*, and a second imaginary straight line L2 that connects the second cut-and-raised parts 21*d* to 21*f* are sloped relative to the airflow direction so that the airflow in the vicinity of the heat-transfer tubes 3 is guided rearward of the heat-transfer tubes 3 in the airflow direction. Here, the angles of attack $\alpha$1, $\alpha$2 of the first straight line L1 and the second straight line L2 with respect to the airflow direction are set so as to be in the range of 10° to 30°.

In this manner, the first cut-and-raised parts 21*a* to 21*c* and the second cut-and-raised parts 21*d* to 21*f* are thus sloped with respect to the airflow direction so that the airflow in the vicinity of the heat-transfer tubes 3 is guided rearward of the heat-transfer tubes 3 in the airflow direction. Accordingly, an effect of renewing the boundary layers can be reliably obtained mainly by the first cut-and-raised part 21*a* and the second cut-and-raised part 21*d* disposed in the forward area of the heat-transfer fins 2 in the airflow direction, among the cut-and-raised parts 21*a* to 21*f*. An effect is also obtained in which the dead water regions formed in the portions of the area rearward of the heat-transfer tubes 3 in the airflow direction are reduced by the first cut-and-raised part 21*c* and the second cut-and-raised part 21*f* disposed in the area rearward of the heat-transfer fins 2 in the airflow direction.

Each of the cut-and-raised parts 21*a* to 21*f* is formed so that the height increases gradually toward the downstream side in the airflow direction. In the present embodiment, each of the cut-and-raised parts 21*a* to 21*f* are substantially trapezoidal or substantially triangular in shape (see FIG. 3; FIG. 3 is a diagram showing the second cut-and-raised parts 21*d* to 21*f*, but the first cut-and-raised parts 21*a* to 21*c* have the same shape), and the maximum height h is formed so as to be lower than the height H of the collar part 23.

Each of the cut-and-raised parts 21*a* to 21*f* formed in the two sides of the heat-transfer tubes 3 is thus divided into a plurality (three in each upper and lower side in the present embodiment) of first cut-and-raised parts 21*a* to 21*c* and second cut-and-raised parts 21*d* to 21*f* in sequence from upstream to downstream in the airflow direction. Accordingly, drain water generated on the heat-transfer fins 2 can be more readily removed from the gaps in the first cut-and-raised parts 21*a* to 21*c* and the gaps in the second cut-and-raised parts 21*d* to 21*f*. A heat transfer enhancing effect produced by the cut-and-raised parts 21*a* to 21*f* can thereby be obtained without being affected by drain water generated on the heat-transfer fins 2.

Slits 22*a* to 22*f* formed in the heat-transfer fins 2 when the cut-and-raised parts 21*a* to 21*f* are cut and raised are arranged above the cut-and-raised parts 21*a* to 21*f* respectively. Concentrically shaped concavities 24 that are concentric with the collar part 23 are provided at the periphery of the collar part 23 in the heat-transfer fins 2. The concavities 24 are formed by concaving the heat-transfer fins 2 in the direction opposite from the collar part 23 in a position in which the cross-section circumscribes the collar part 23 in the manner shown in FIG. 2.

The cut-and-raised parts 21*a* to 21*f* are thus formed by cutting and raising the heat-transfer fins 2 from the top toward the bottom. Accordingly, first slits 22*a* to 22*c* are formed between the heat-transfer tubes 3 and the first cut-and-raised parts 21*a* to 21*c* where drain water is particularly readily trapped, and the drain water is less likely to be trapped between the heat-transfer tubes 3 and the first cut-and-raised parts 21*a* to 21*c*. For this reason, drain water is more readily removed from the heat-transfer fins 2. Also, the concavities 24 are formed in the entire periphery of the heat-transfer tubes 3 in the heat-transfer fins 2. Therefore, the drain water is temporarily trapped in the concavities 24 and then made to flow and be removed after a predetermined amount or more of the drain water has accumulated. Accordingly, drain water can be removed without being trapped between the heat-transfer tubes 3 and the first cut-and-raised parts 21*a* to 21*c*.

The first cut-and-raised parts 21*a* to 21*c* and the second cut-and-raised parts 21*d* to 21*f* are straightly aligned on the first straight line L1 and the second straight line L2 from the upstream side of the airflow to the downstream side, whereby the first cut-and-raised part 21*c*, which is disposed on the heat-transfer fins 2 downstream in the airflow direction has the same slope as the first cut-and-raised part 21*a* disposed on the upstream side of the airflow direction, and the second cut-and-raised part 21*f* has the same slope as the second cut-and-raised part 21*d* disposed on the upstream side of the airflow direction, among the cut-and-raised parts 21*a* to 21*f*. Therefore, not only can dead water regions formed in the area rearward of the heat-transfer tubes 3 in the airflow direction be reduced, but also new dead water regions can be prevented from forming behind the first cut-and-raised part 21*c* and the second cut-and-raised part 21*f*.

As described above, in the finned tube heat exchanger 1 of the present embodiment, a heat transfer enhancing effect produced by the cut-and-raised parts 21*a* to 21*f* can be obtained without being affected by drain water generated on the heat-transfer fins 2, and since it is also possible to prevent the formation to new dead water zones behind the first cut-and-raised part 21*c* and the second cut-and-raised part 21*f*, the cut-and-raised parts 21*a* to 21*f* provide a heat transfer enhancing effect and better drainage characteristics.

In the finned tube heat exchanger 1, the cut-and-raised parts 21*a* to 21*f* are shaped so that the height gradually increases toward the downstream side in the airflow direction, whereby longitudinal vortices can be generated behind the cut-and-raised parts 21*a* to 21*f*. Therefore, the cut-and-raised parts 21*a* to 21*f* can further improve heat transfer enhancing effect.

<Characteristics>

(1)

In the present embodiment, all of the first cut-and-raised parts 21*a* to 21*c* on the heat-transfer fins 2 below the heat-transfer tubes 3 are formed by cut-and-raise machining from the top toward the bottom. Drain water is sometimes trapped between the first cut-and-raised parts and the heat-transfer tubes 3. Therefore, all of the first cut-and-raised parts are formed by cut-and-raise machining from the top toward the bottom, whereby trapping of drain water can be minimized.

Consequently, first slits 22*a* to 22*c* are formed between the heat-transfer tubes 3 and the first cut-and-raised parts 21*a* to 21*c*, and drain water is not liable to be trapped between the heat-transfer tubes 3 and the first cut-and-raised parts 21*a* to 21*c*. Accordingly, the cut-and-raised parts 21*a* to 21*f* can provide a heat transfer enhancing effect while allowing drain water to be efficiently removed.

(2)

In the present invention, the concavities 24 are formed in the heat-transfer fins 2 around the entire periphery of the heat-transfer tubes 3. Therefore, the drain water is temporarily trapped in the concavities 24 and then made to flow and be removed after a predetermined amount or more of the drain water has accumulated. Accordingly, drain water can be removed without being trapped between the heat-transfer tubes 3 and the first cut-and-raised parts 21*a* to 21*c*. As a result, an effect can be obtained in which heat transfer is enhanced.

Modified Example (1)

All three of the first cut-and-raised parts 21*a* to 21*c* below the heat-transfer tubes 3 in the present embodiment are formed by cutting and raising the heat-transfer fins 2 from the top, but no limitation is imposed thereby, and it is possible to form only the first cut-and-raised part 41*c* in a position most proximate to the heat-transfer tubes 3 by cut-and-raise machining from the top, and the other first cut-and-raised parts 41*a*, 42*b* may be formed by cut-and-raise machining from the bottom (see FIG. 4). In this case, not only the first cut-and-raised part 41*c*, but also the first cut-and-raised part 41*b* may be formed by cut-and-raise machining from the top. The reference numerals 4, 4*a* in FIG. 4 are substituted for 2, 2*a* in the present embodiment, and the 40s are substituted for 20s (in the present embodiment).

Drain water is most readily trapped between the heat-transfer tubes 3 and the first cut-and-raised part 41*c* in the region (first region R) nearest to the heat-transfer tubes 3. Therefore, the amount of trapped drain water can be minimized by forming the first cut-and-raised part 41*c* of the first region R by cut-and-raise machining from the top toward the bottom.

Figure 4:
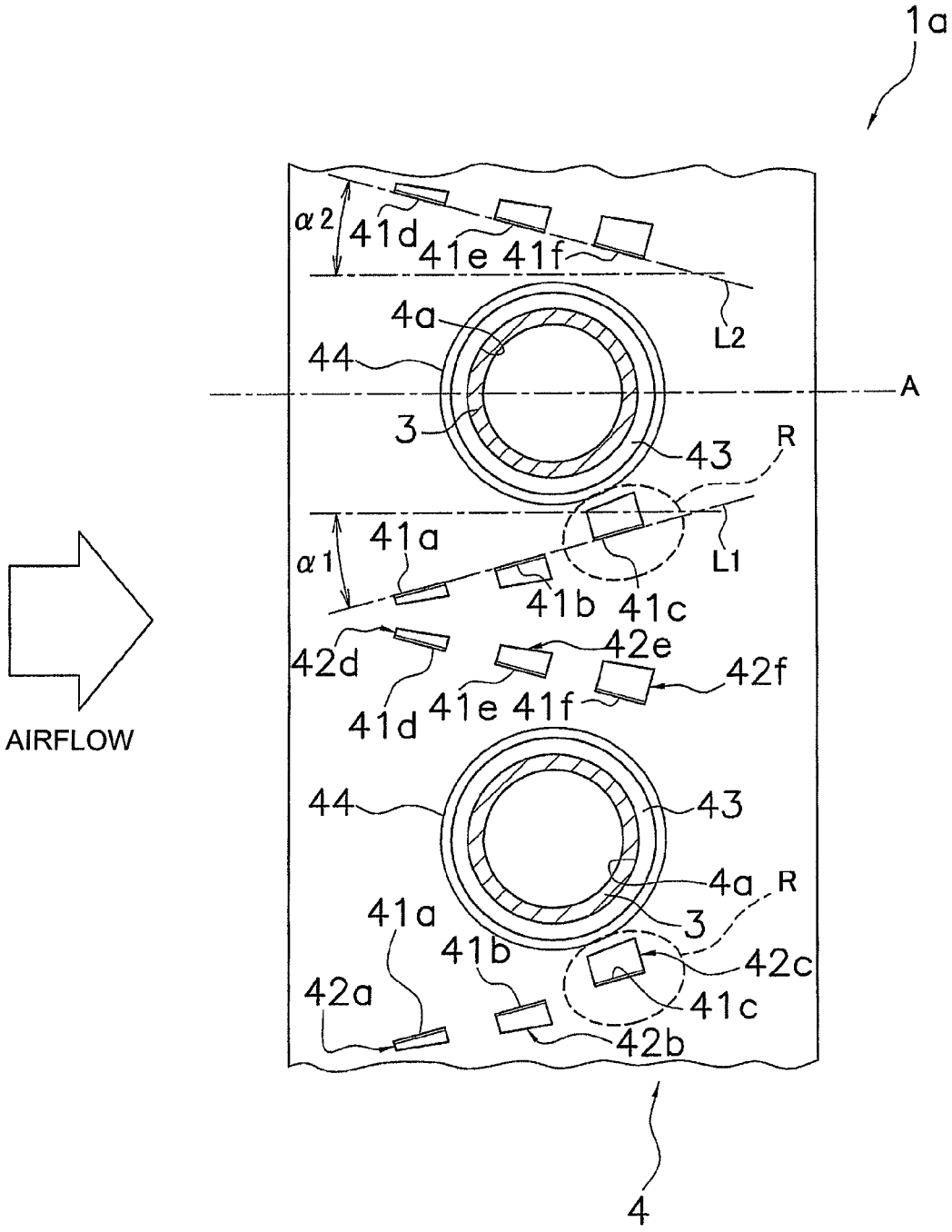
FIG. 4 is a cross-sectional view of the finned tube heat exchanger according to modified example (1).

In the finned tube heat exchanger 1*a* such as the one shown in FIG. 4, droplets of drain water are thus less liable to be trapped between the heat-transfer tubes 3 and the first cut-and-raised part 41*c* because at least the first cut-and-raised part 41*c* provided in the position most proximate to the heat-transfer tubes 3 is formed by cut-and-raise machining from the top. Accordingly, drain water can be removed with good efficiency and a heat transfer enhancing effect can be obtained.

(2)

Figure 5:
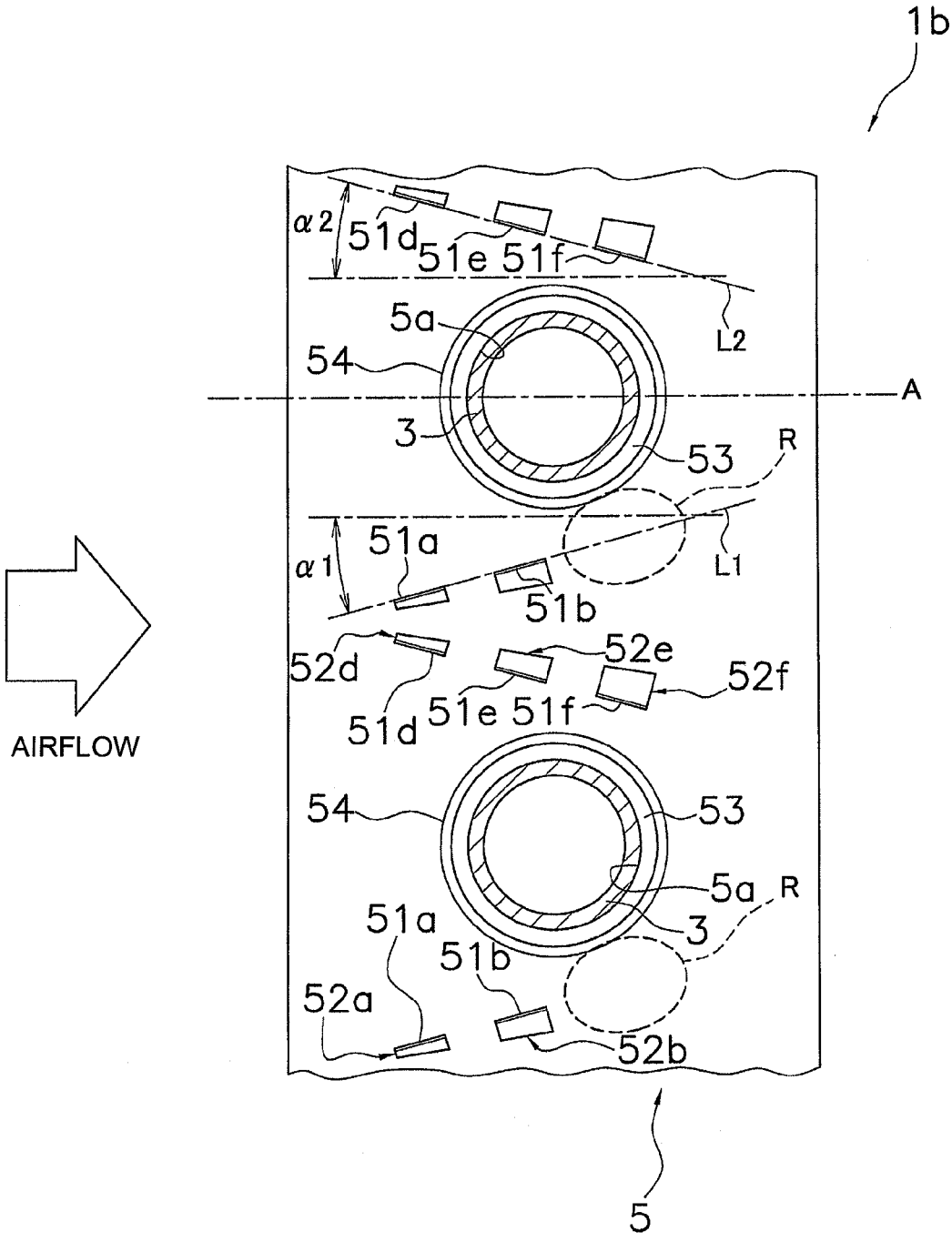
FIG. 5 is a cross-sectional view of the finned tube heat exchanger according to modified example (2).
Figure 6:
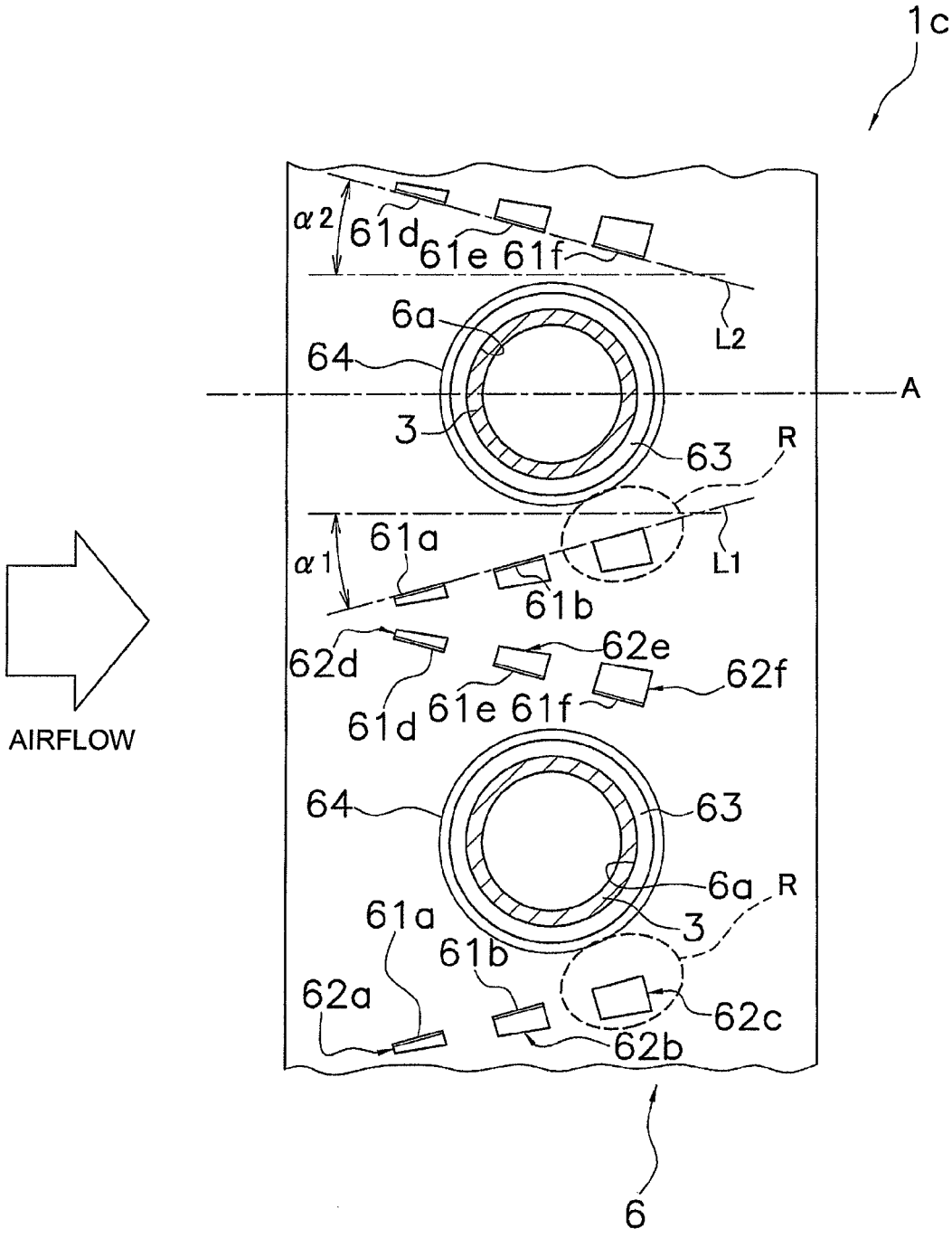
FIG. 6 is a cross-sectional view of the finned tube heat exchanger according to modified example (2).

In the present embodiment, the first cut-and-raised parts 21*a* to 21*c* below the heat-transfer tubes 3 are formed by cut-and-raise machining from the top of the heat-transfer fins 2, but no limitation is imposed thereby, and it is possible to form cut-and-raised parts by performing cutting and raising from the bottom, as shown in FIG. 5, so as to achieve vertical symmetry with second cut-and-raised parts 51*d* to 51*f* on the upper side with respect to the horizontal plane A that passes through the center of the heat-transfer tubes 3. However, in this case, first cut-and-raised parts 51*a*, 51*b* are formed so as to be vertically symmetric with only two second cut-and-raised parts 51*d*, 51*e* among the second cut-and-raised parts 51*d* to 51*f*, and cut-and-raised parts are not provided in a position that corresponds to the second cut-and-raised part 51*f*. It is furthermore possible to provide only one first cut-and-raised part so as to leave only the first cut-and-raised part 51*a* furthest from the heat-transfer tubes 3. It is also possible to provide only slits in the manner shown in FIG. 6 in place of providing cut-and-raised parts. In this case, the reference numerals 5,5*a* in FIG. 5 are substituted for 2,2*a* in the preset embodiment, and the 50s are substituted for the 20s in the present embodiment. The reference numerals 6, 6*a* in FIG. 6 are substituted for 2, 2*a*, and the 60s are substituted for 20s in the present embodiment.

Drain water is most readily trapped between the heat-transfer tubes 3 and the first cut-and-raised part when a first cut-and-raised part is present in the region (first region R) nearest to the heat-transfer tubes 3. In the finned tube heat exchangers 1*b*, 1*c*, a first cut-and-raised part was not provided in the first region R in the heat-transfer fins 5, 6.

Therefore, drain water can be made less likely to be trapped between the heat-transfer tubes 3 and the first cut-and-raised part. Accordingly, the cut-and-raised parts 51*a*, 51*b*, 51*d* to 51*f*, and the cut-and-raised parts 61*a*, 61*b*, 61*d* to 61*f* can produce a heat transfer enhancing effect without being affected by drain water generated on the heat-transfer fins 5, 6.

(3)

Figure 7:
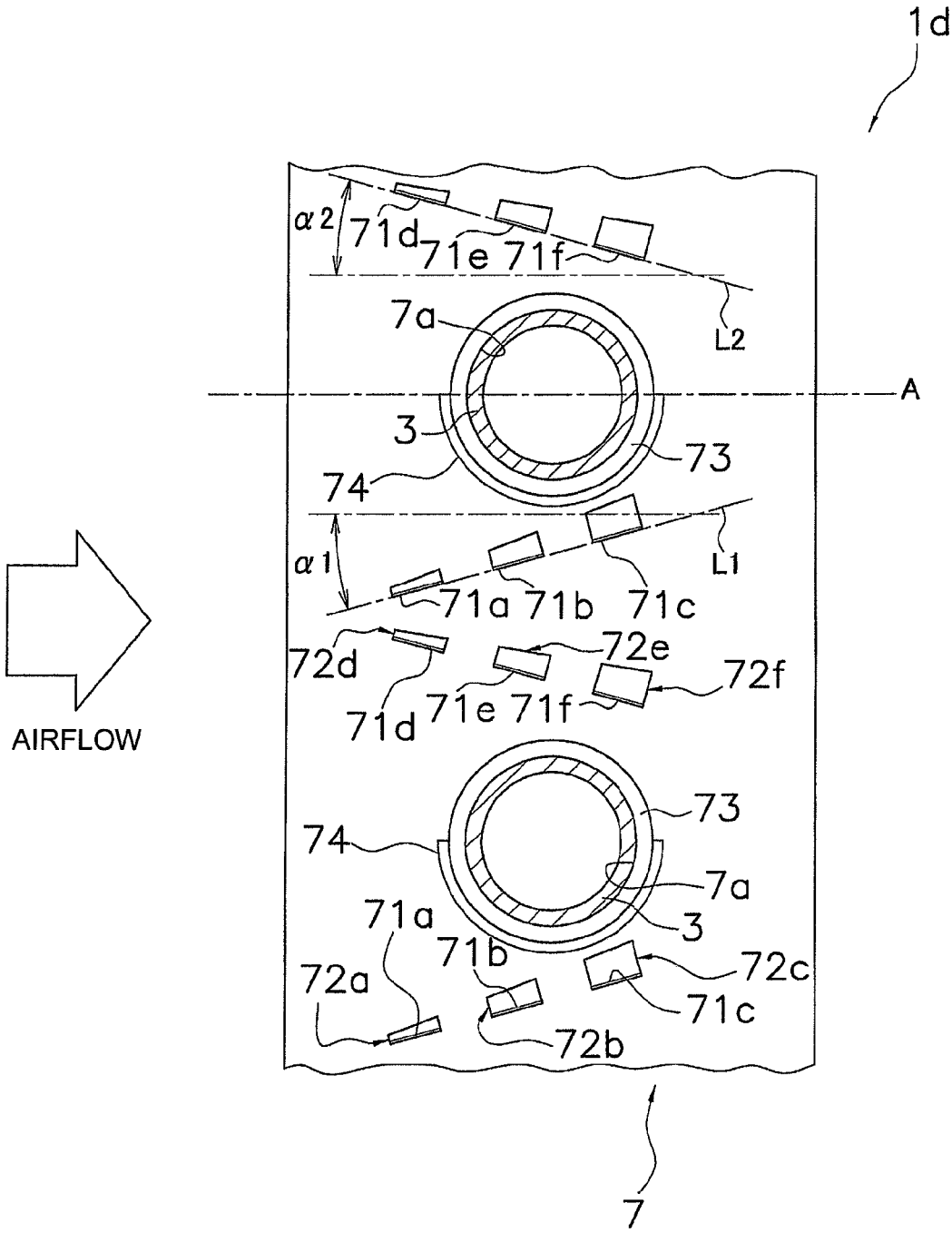
FIG. 7 is a cross-sectional view of the finned tube heat exchanger according to modified example (3).

In the present embodiment, the concavities 24 are formed in the entire periphery of the heat-transfer tubes 3, but no limitation is imposed thereby, and arched concavities 74 may be formed (see FIG. 7) only on the lower part side of the heat-transfer tubes 3 (below the horizontal plane A that passes through the center of the heat-transfer tubes 3). In this case, the reference numerals 7, 7*a* in FIG. 7 are substituted for 2, 2*a* in the present embodiment, and the 70s are substituted with the 20s in the present embodiment.

(4)

Figure 8:
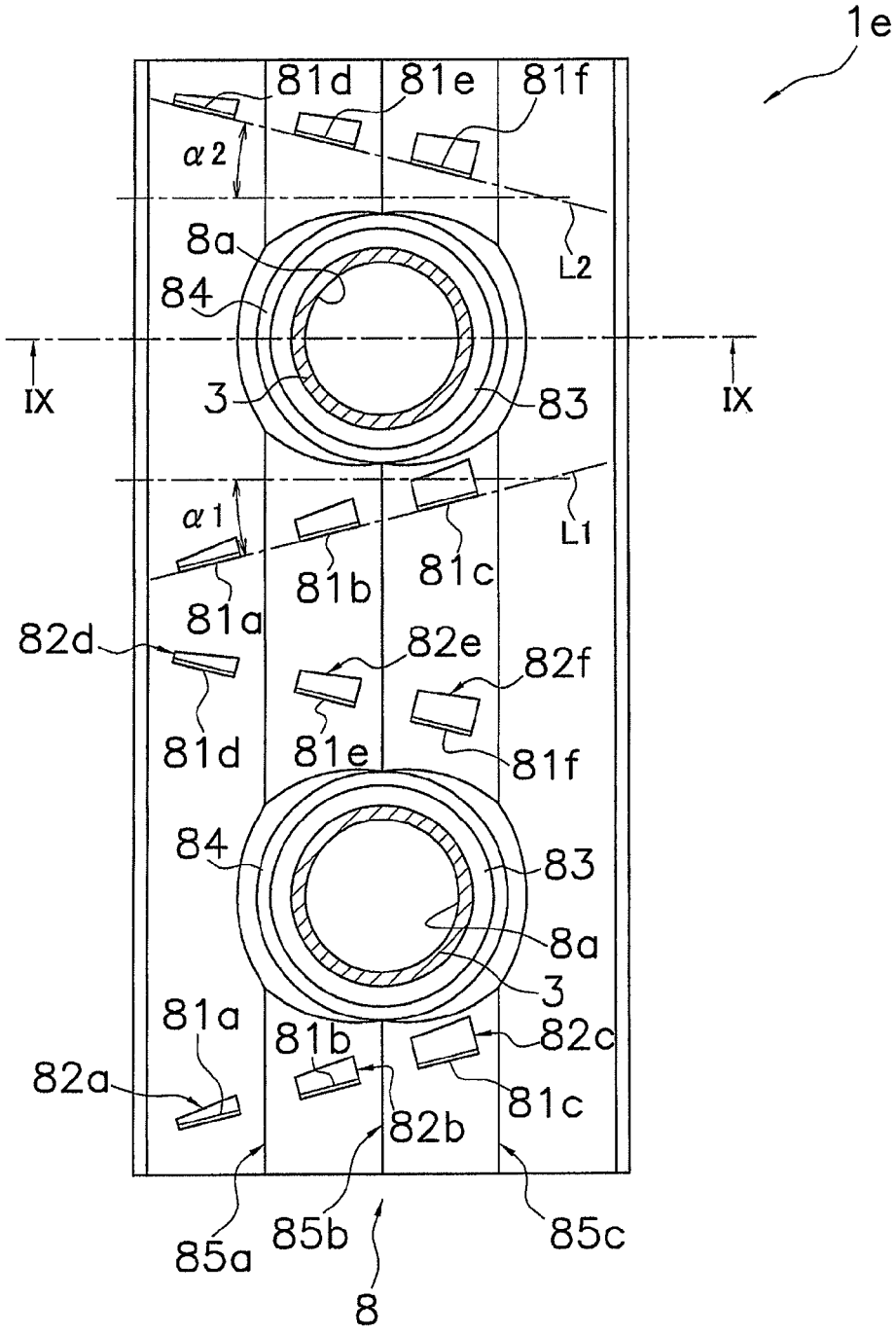
FIG. 8 is a cross-sectional view of the finned tube heat exchanger according to modified example (4).
Figure 9:
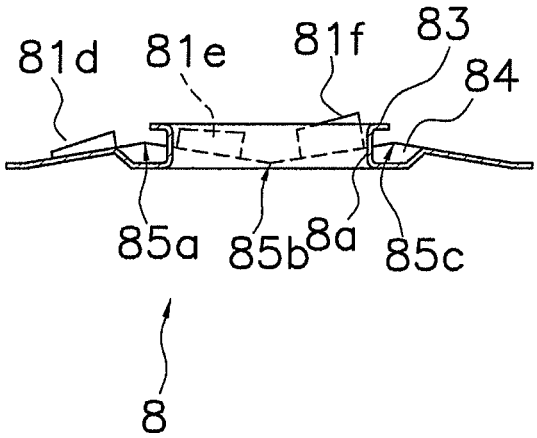
FIG. 9 is a cross-sectional view along the line IX-IX of FIG. 8.

In the present embodiment, flat fins are used as the heat-transfer fins 2, but no limitation is imposed thereby, and waffle-shaped heat-transfer fins 8 (see FIG. 8) having folds 85*a* to 85*c* that are parallel to the perpendicular direction may be used. FIG. 8 is a cross-sectional view of a finned tube heat exchanger 1*e* in which waffle-shaped heat-transfer fins 8 have been adopted, and FIG. 9 is a cross-sectional view (excluding the heat-transfer tubes 3) along the line IX-IX of FIG. 8. Here, the folds 85*a* to 85*c* shown in FIG. 9 are configured so that the folds 85*a*, 85*c* are convex folds, and the fold 85*b* is a concave fold.

Since the heat-transfer fins 8 are shaped as waffles having folds 85*a* to 85*c* formed in the direction substantially orthogonal to the airflow direction, an air vortex can be generated and heat transfer between the heat-transfer fins 8 and air can be enhanced. Drain water generated in the vicinity of the heat-transfer tubes 3 can be made to readily flow down along the fold 85*b*, which is a concave fold. Accordingly, the heat transfer enhancing effect of the cut-and-raised parts 81*a* to 81*f* can be obtained without being affected by the drain water generated on the heat-transfer fins. The reference numerals 8, 8*a* in FIGS. 8, 9 of the present modified example (4) are substituted for 2, 2*a* in the present embodiment, and the 80s are substituted for the 20s in the present embodiment.

(5)

In the present embodiment, the concavities 24 provided to the heat-transfer fins 2 have a circular shape that is concentric with the collar part 23, but no limitation is imposed thereby, and also possible are concavities 94 (see FIG. 10) shaped so that the lower end parts 94*a* and the upper end parts 94*b* of the concavities 24 in the heat-transfer fins 2 are made to protrude in a pointed manner, as well as concavities 104 (see FIG. 11) shaped so that only the lower end parts 104*a* of the concavities 24 in the heat-transfer fins 2 are made to protrude. The cross-sections of the heat-transfer fins 9 and the heat-transfer fins 10 in the present modified example (5) have the same shape as the cross-section of the heat-transfer fins 8 in modified example (4).

Figure 10:
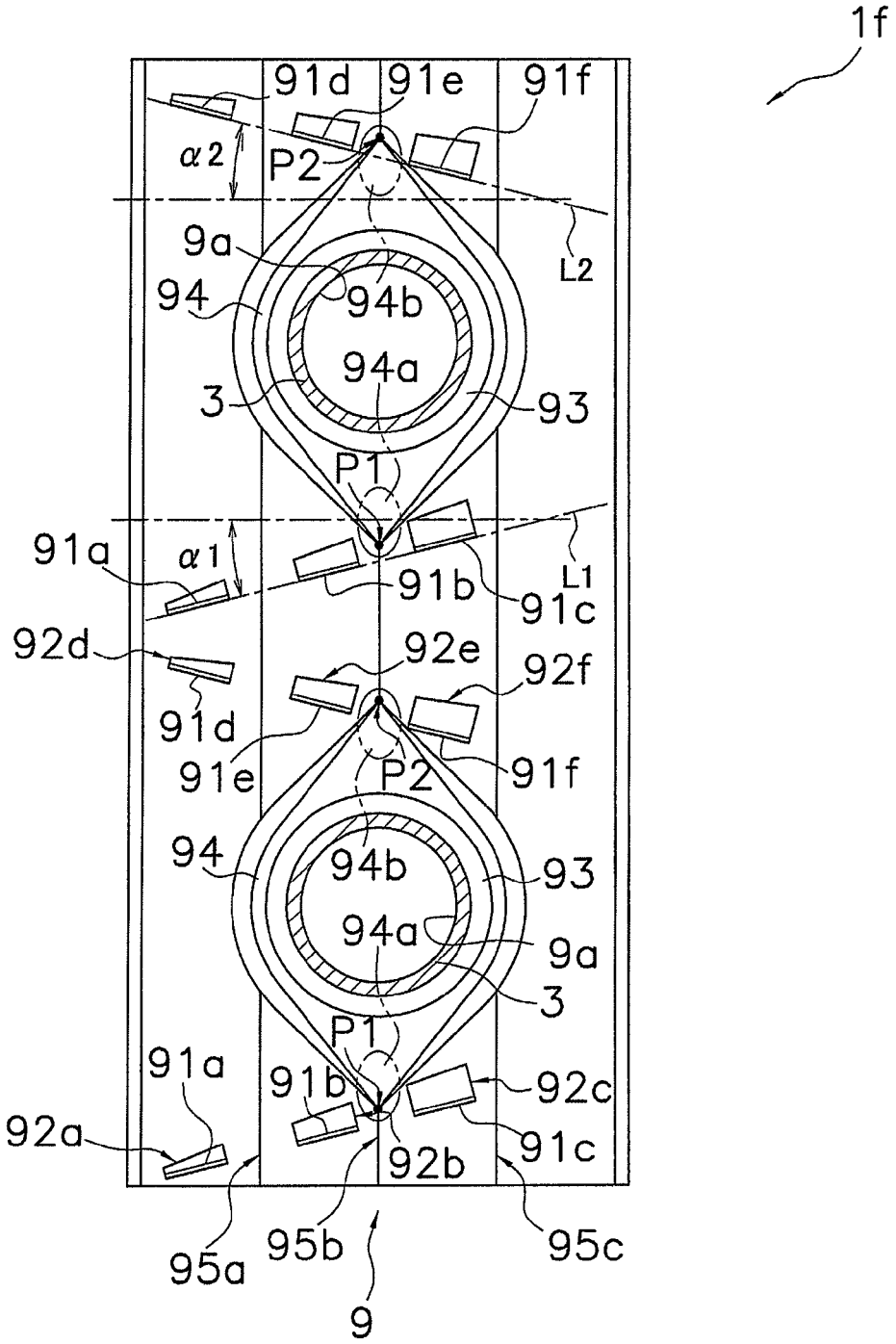
FIG. 10 is a cross-sectional view of the finned tube heat exchanger according to modified example (5).
Figure 11:
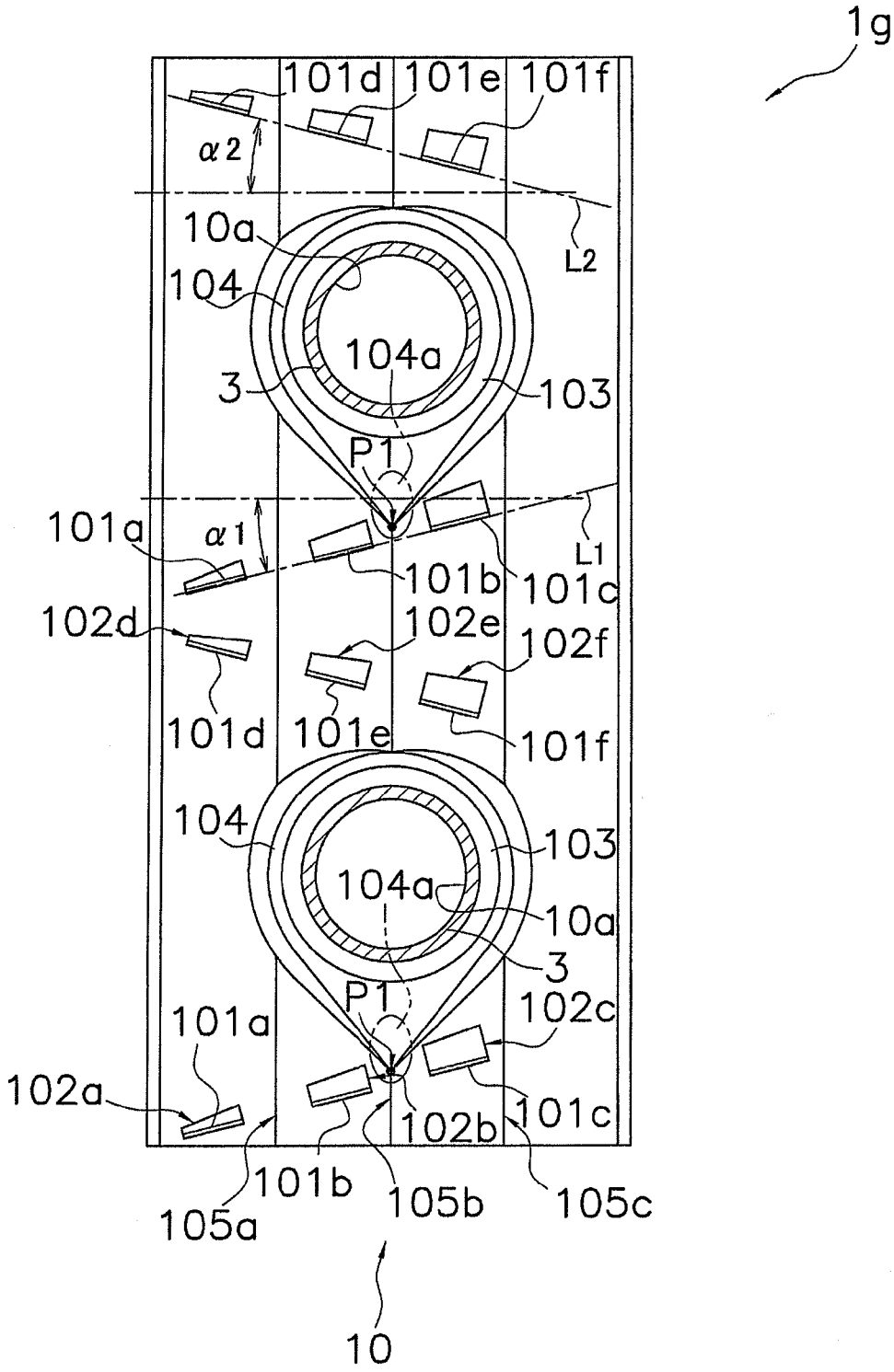
FIG. 11 is a cross-sectional view of the finned tube heat exchanger according to modified example (5).

In the present modified example (5), the heat-transfer fins 9, 10 of the finned tube heat exchangers 1*f*, 1*g* in FIGS. 10 and 11 are waffle-shaped heat-transfer fins 9, 10 having folds 95*a* to 95*c* and 105*a* to 105*c* that are parallel to the perpendicular direction in the same manner as the heat-transfer fins 8 of modified example (4). In this case, the concavities 94 having the protruding lower end parts 94*a* and upper end parts 94*b* are formed so that the protruding lower end parts 94*a* and upper end parts 94*b* of the concavities 94 match the fold 95*b*, which is a concave fold and which is one of the folds 95*a* to 95*c* of the waffle-shaped heat-transfer fins 9, as shown in FIG. 10, for example. Here, a first point P1 on the lower part of the concavities 94 is set to be a vertex of the lower end parts 94*a*. Also, a second point P2 at the upper part of the concavities 94 is set to be a vertex of the upper end parts 94*b*.

The concavities 104 in which only the lower end parts 104*a* protrude are formed so that the protruding lower end parts 104*a* of the concavities 104 match the fold 105*b*, which is a concave fold and which is one of the folds 105*a* to 105*c* of the waffle-shaped heat-transfer fins 10 in the same manner as the concavities 94 formed in the heat-transfer fins 9 of FIG. 10, as shown in FIG. 11, for example. Here, a first point P1 on the lower part of the concavities 104 is set to be a vertex of the lower end parts 104*a*.

In the finned tube heat exchangers 1*f*, 1*g*, concavities are thus formed so that the protruding lower end parts 94*a*, 104*a* of the concavities 94, 104 are superimposed on the folds 95*b*, 105*b*, which are concave folds and which are two of the folds 95*a* to 95*c* and 105*a* to 105*c* of the waffle-shaped heat-transfer fins 9, 10 (also superimposed on the upper end parts 94*b* of the concavities 94 in the case of FIG. 10). Therefore, drain water generated on the heat-transfer fins 9, 10 can be readily removed from the concavities 94, 104. Accordingly, drain water generated in the finned tube heat exchangers 1*f*, 1*g* can be smoothly made to flow downward.

The reference numerals 9,9*a* in FIG. 10 of the present modified example (5) are substituting for 2, 2*a* in the present embodiment, and the 90s are substituting for the 20s in the present embodiment. The reference numerals 10, 10*a* in FIG. 11 of the present modified example (5) are substituting for 2, 2*a* in the present embodiment, and the 100s are substituting for the 20s in the present embodiment.

(6)

Figure 12:
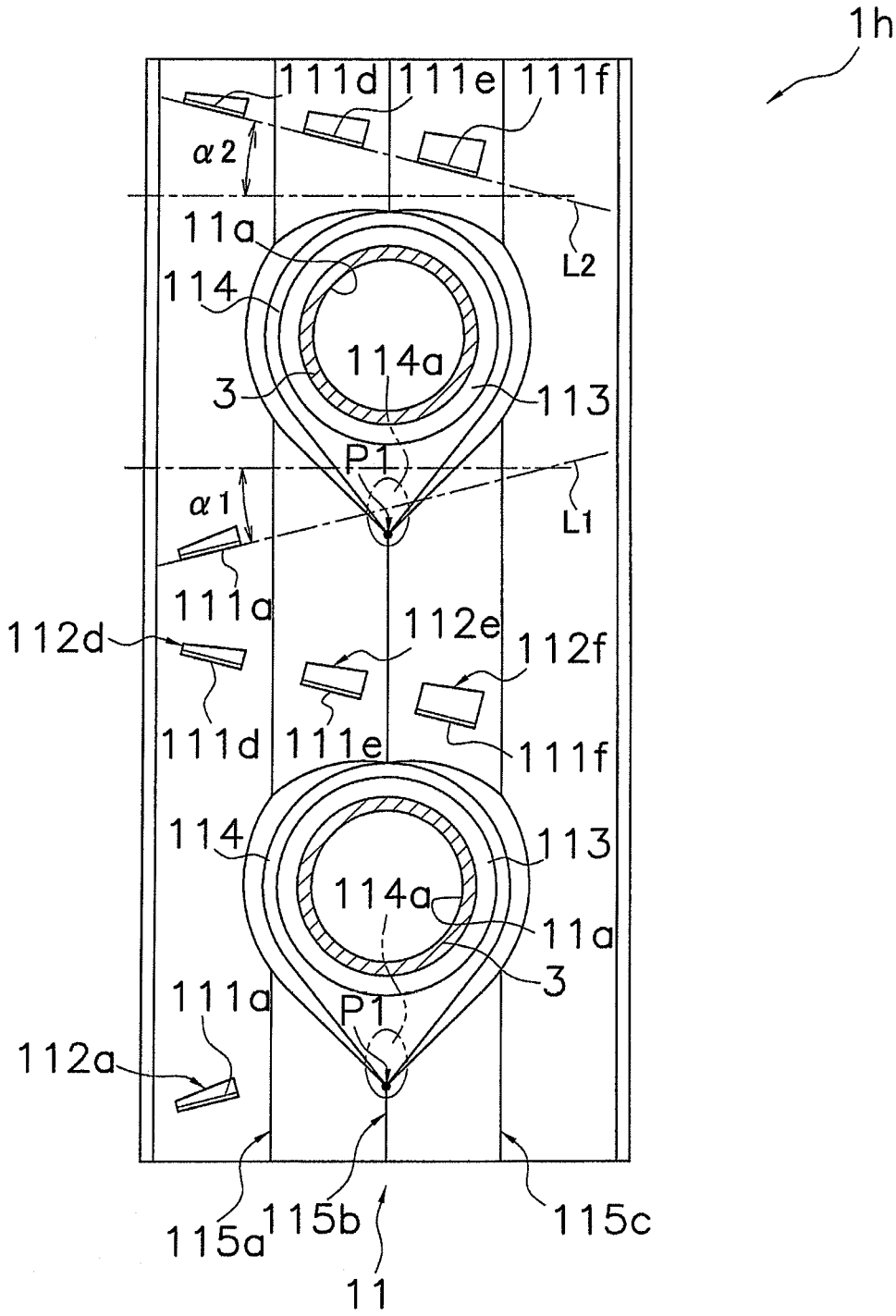
FIG. 12 is a cross-sectional view of the finned tube heat exchanger according to modified example (6).

The three first cut-and-raised parts 101*a* to 101*c* disposed below the heat-transfer tubes 3 in the finned tube heat exchanger 1*g* of modified example (5) are formed by cutting and raising the heat-transfer fins 10, but no limitation is imposed thereby, and it is possible to use heat-transfer fins 11 (see FIG. 12) shaped so that a first cut-and-raised part 111*a* is cut and raised in a region that excludes the region directly below the heat-transfer tubes 3. The cross-section of the heat-transfer fins 11 in modified example (6) is the same shape as the cross-section of the heat-transfer fins 8 in modified example (4). The reference numerals 11, 11*a* in FIG. 12 of the present modified example (6) are substituting for 8, 8*a* in modified example (4), and the 110s are substituting for the 80s in modified example (4).

(7)

Figure 13:
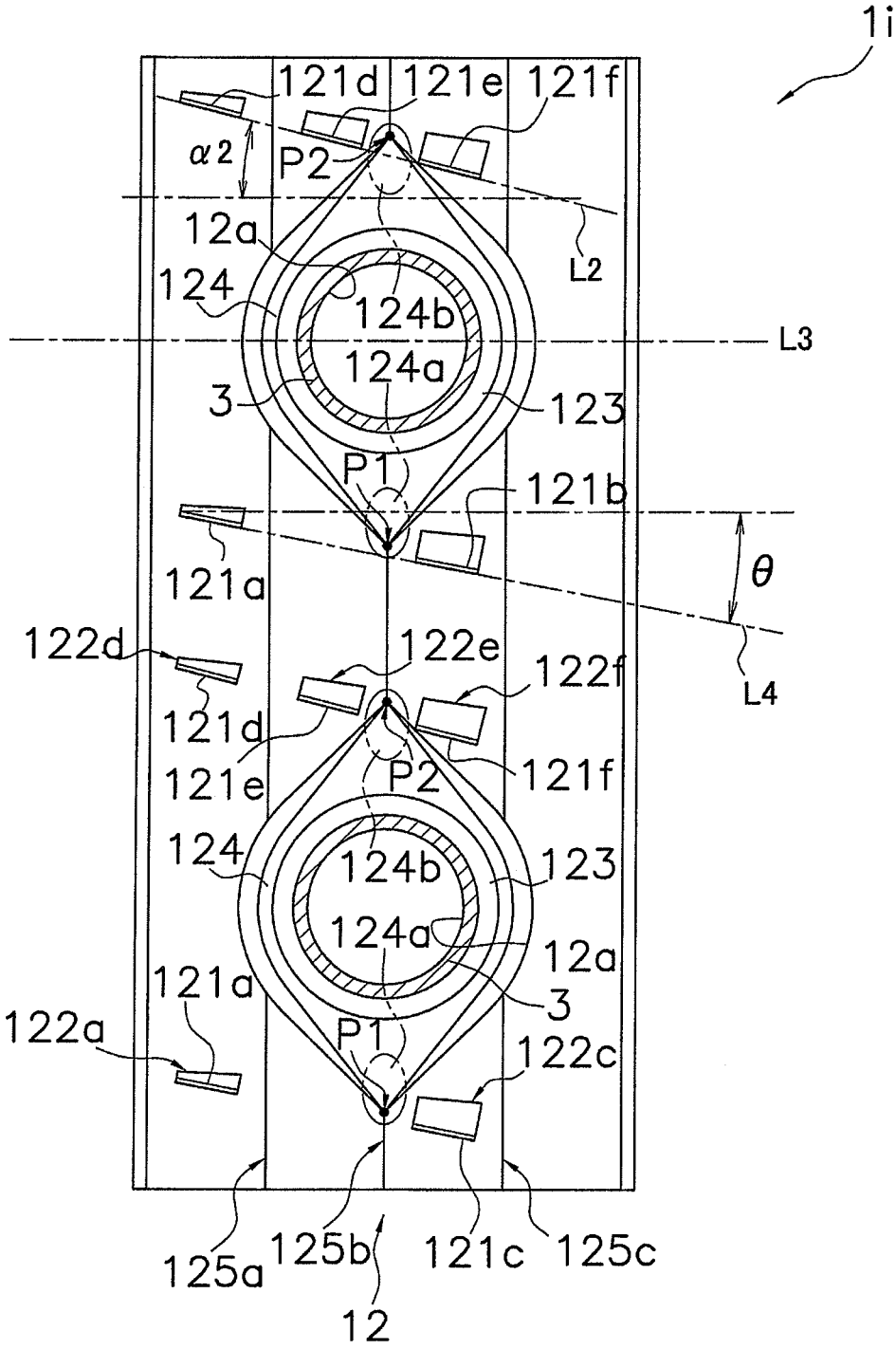
FIG. 13 is a cross-sectional view of the finned tube heat exchanger according to modified example (7).

In the finned tube heat exchanger 1*f* of the modified example (5), first cut-and-raised parts 91*a* to 91*c* below the heat-transfer tubes 3 are sloped so that the first cut-and-raised parts 91*c* on the downstream side of the airflow direction are closer to the straight line (third straight line L3 in FIG. 13) that passes through the center axis of the heat-transfer tubes 3 and is parallel to the airflow direction than the first cut-and-raised parts 91*a* on the upstream side, but no limitation is imposed thereby. For example, first cut-and-raised parts 121*a*, 121*b* below the heat-transfer tubes 3 may be formed so that the first cut-and-raised parts 121*b* on the downstream side of the airflow direction slope away and are farther away from the third straight line than the first cut-and-raised parts 121*a* on the upstream of the airflow direction, in the manner of the heat-transfer fins 12 of the finned tube heat exchanger 1*i* of FIG. 13. In this case, the first cut-and-raised parts 121*a*, 121*b* are arranged on the fourth straight line L4 that is inclined at an angle θ that is opposite to the second straight line L2 on which the second cut-and-raised parts 121*c* to 121*e* are arranged. The cross-section of the heat-transfer fins 12 in modified example (7) have the same shape as the cross-section of the heat-transfer fins 8 in modified example (4). The reference numerals 12, 12*a* in FIG. 13 of the present modified example (7) are substituting for 8, 8*a* in modified example (4), and the 120s are substituting for the 80s in modified example (4).

<Other Embodiments>

Embodiments of the present invention were described above with reference to the drawings, but the specific configuration is not limited by these embodiments, and modifications are possible within a scope that does not depart from the spirit of the invention.

INDUSTRIAL APPLICABILITY

The finned tube heat exchanger according to the present invention allows drain water to be more readily removed, can effectively provide a heat transfer effect, and can be used as a finned tube heat exchanger, and particularly as a finned tube heat exchanger provided with heat-transfer fins disposed along an airflow, and a plurality of heat-transfer tubes inserted into the heat-transfer fins and arranged in a direction substantially orthogonal to the direction of airflow.

The invention claimed is:

1. A finned tube heat exchanger comprising:

a plurality of heat-transfer fins disposed along an airflow direction; and a plurality of heat-transfer tubes inserted into the heat-transfer fins and arranged in a direction substantially orthogonal to the airflow direction and the heat-transfer tubes being arranged with respect to each other in a vertical direction, a first axis extending in a first direction and being perpendicular to and passing through longitudinal center axes of the heat transfer tubes, the longitudinal center axes being parallel to a second vertical direction, and the airflow direction being parallel to a third direction that is perpendicular to the first and second directions, a plurality of annular collar parts protruding to one side in a plate thickness direction of each of the heat-transfer fins, with each of the heat-transfer tubes being in close contact with an inside surface of one of the annular collar parts protruding from each of the heat transfer fins, each of the heat transfer fins including a first set of cut-and-raised parts formed below each of the heat-transfer tubes with each first set of cut-and-raised parts being aligned along two sides from an upstream side toward a downstream side in the airflow direction and a second set of cut-and-raised parts formed above each of the heat-transfer tubes with each second set of cut-and-raised parts being aligned along two sides from an upstream side toward a downstream side in the airflow direction, each of the first set of cut-and-raised parts and the second set of cut-and-raised parts being formed by cut-and-raise machining, the first set of cut-and-raised parts and the second set of cut-and-raised parts being connected by first and second straight lines, respectively, that are sloped relative to the airflow direction as viewed along the second direction in order to guide airflow in the vicinity of the heat-transfer tubes to the rearward sides of the heat-transfer tubes in the airflow direction, the first straight line and the first set of cut-and-raised parts being parallel as viewed along the second direction, and the second straight line and the second set of cut-and-raised parts being parallel as viewed along the second direction, the first and second sets of cut-and-raised parts being disposed between a pair of heat transfer tubes that are directly adjacent to each other, the directly adjacent heat transfer tubes being aligned with each other as viewed along a direction parallel to the first axis, the first set of cut-and-raised parts being aligned with each other along the first straight line as viewed along the second direction, and the second set of cut-and-raised parts being aligned with each other along the second straight line as viewed along the second direction, the first and second sets of cut-and-raised parts disposed between the directly adjacent heat transfer tubes being at least partially aligned with the directly adjacent heat transfer tubes as viewed along the first direction, among the first set of cut-and-raised parts at least one first cut-and-raised part in a region nearest to each of the heat-transfer tubes being formed by cut-and-raise machining from the top toward the bottom, and at least one slit being formed between the at least one first cut-and-raised part and each heat-transfer tube, and each of heat transfer fins further including a plurality of concavities with each of the concavities formed by concaving in a direction opposite from a direction in which each of the collar parts protrudes on a periphery of one of the heat-transfer tubes at least partially below a horizontal plane that passes through a center axis of the heat-transfer tubes.

2. The finned tube heat exchanger according to claim 1, wherein each of the concavities is formed about an entirety of the periphery of one of the heat-transfer tubes.

3. The finned tube heat exchanger according to claim 1, wherein each of the heat-transfer fins has linear sections extending laterally that are inclined in alternating plate thickness directions as each section extends in the airflow direction.

4. The finned tube heat exchanger according to claim 1, wherein each of the concavities has a lower end part extending to a pointed first point and an upper end part extending to a pointed second point such that each concavity has a protruding shape toward the lower and upper end parts thereof.

5. The finned tube heat exchanger according to claim 1, wherein each of the concavities has a lower end part extending to a pointed first point such that each concavity has a protruding shape toward the lower end part thereof.

6. The finned tube heat exchanger according to claim 3, wherein the linear sections are shaped as concave folds; and each of the concavities has a lower end part extending to a pointed first point such that each concavity has a protruding shape toward the lower end part thereof, and each of the concavities is formed so that the lower end part thereof is aligned with one of the concave folds.

7. The finned tube heat exchanger according to claim 6, wherein the first cut-and-raised parts are arranged such that a region of each heat transfer fin directly below each heat-transfer tube is free of cut-and-raised parts.

8. The finned tube heat exchanger according to claim 6, wherein the first straight line that connects the first set of cut-and-raised parts is sloped in relation to a third straight line that passes through the center axis of the heat-transfer tubes and is parallel to the airflow direction so that the downstream side of the fourth straight line is farther away from the third straight line than the upstream side of the fourth straight line; and the second straight line that connects the second set of cut-and-raised parts is sloped in relation to the third straight line so that the downstream side of the second straight line is closer to the third straight line than the upstream side of the second straight line.

9. The finned tube heat exchanger according to claim 2, wherein each of the heat-transfer fins has linear sections extending laterally that are inclined in alternating plate thickness directions as each section extends in the airflow direction.

10. The finned tube heat exchanger according to claim 9, wherein the linear sections are shaped as concave folds; and each of the concavities has a lower end part extending to a pointed first point such that each concavity has a protruding shape toward the lower end part thereof, and each of the concavities is formed so that the lower end part thereof is aligned with one of the concave folds.

11. The finned tube heat exchanger according to claim 10, wherein the first cut-and-raised parts are arranged such that a region of each heat transfer fin directly below each heat-transfer tube is free of cut-and-raised parts.

12. The finned tube heat exchanger according to claim 11, wherein the first straight line that connects the first set of cut-and-raised parts is sloped in relation to a third straight line that passes through the center axis of the heat-transfer tubes and is parallel to the airflow direction so that the downstream side of the fourth straight line is farther away from the third straight line than the upstream side of the fourth straight line; and the second straight line that connects the second set of cut-and-raised parts is sloped in relation to the third straight line so that the downstream side of the second straight line is closer to the third straight line than the upstream side of the second straight line.

13. The finned tube heat exchanger according to claim 10, wherein the first straight line that connects the first set of cut-and-raised parts is sloped in relation to a third straight line that passes through the center axis of the heat-transfer tubes and is parallel to the airflow direction so that the downstream side of the fourth straight line is farther away from the third straight line than the upstream side of the fourth straight line; and the second straight line that connects the second set of cut-and-raised parts is sloped in relation to the third straight line so that the downstream side of the second straight line is closer to the third straight line than the upstream side of the second straight line.

14. The finned tube heat exchanger according to claim 2, wherein each of the concavities has a lower end part extending to a pointed first point and an upper end part extending to a pointed second point such that each concavity has a protruding shape toward the lower and upper end parts thereof.

15. The finned tube heat exchanger according to claim 2, wherein each of the concavities has a lower end part extending to a pointed first point such that each concavity has a protruding shape toward the lower end part thereof.

16. The finned tube heat exchanger according to claim 7, wherein the first straight line that connects the first set of cut-and-raised parts is sloped in relation to a third straight line that passes through the center axis of the heat-transfer tubes and is parallel to the airflow direction so that the downstream side of the fourth straight line is farther away from the third straight line than the upstream side of the fourth straight line; and the second straight line that connects the second set of cut-and-raised parts is sloped in relation to the third straight line so that the downstream side of the second straight line is closer to the third straight line than the upstream side of the second straight line.

17. The finned tube heat exchanger according to claim 1, wherein all of the cut-and-raised parts on the heat-transfer fins below the heat-transfer tubes are formed by cut-and-raise machining from the top toward the bottom and slits are formed between each of the heat-transfer tubes and each of the cut-and-raised parts.

* * * * *